US011236457B2

(12) United States Patent
Gates et al.

(10) Patent No.: US 11,236,457 B2
(45) Date of Patent: Feb. 1, 2022

(54) USER-INTERFACE ASSEMBLY FOR AN APPLIANCE

(71) Applicant: WHIRLPOOL CORPORATION, Benton Harbor, MI (US)

(72) Inventors: Anthony Michael Gates, St. Joseph, MI (US); John Aruna, St. Joseph, MI (US); Amith Basavaraju, Mandya District (IN); Srivatsa Vishwanath, Bengaluru (IN)

(73) Assignee: Whirlpool Corporation, Benton Harbor, MI (US)

( * ) Notice: Subject to any disclaimer, the term of this patent is extended or adjusted under 35 U.S.C. 154(b) by 177 days.

(21) Appl. No.: 16/588,017

(22) Filed: Sep. 30, 2019

(65) Prior Publication Data

US 2021/0095412 A1 Apr. 1, 2021

(51) Int. Cl.
*D06F 34/28* (2020.01)
*D06F 39/12* (2006.01)

(52) U.S. Cl.
CPC ..... *D06F 34/28* (2020.02); *D06F 39/12* (2013.01)

(58) Field of Classification Search
None
See application file for complete search history.

(56) References Cited

U.S. PATENT DOCUMENTS

| | | | | | |
|---|---|---|---|---|---|
| 2,786,730 | A * | 3/1957 | Thurston | D06F 39/12 | 312/315 |
| 3,072,782 | A * | 1/1963 | Sheeley | D06F 34/34 | 362/85 |
| 3,253,874 | A | 5/1966 | Czech | | |
| 4,268,098 | A * | 5/1981 | Kretchman | D06F 39/12 | 312/210 |
| 4,288,133 | A | 9/1981 | Deatherage | | |
| 4,572,596 | A * | 2/1986 | Weir | D06F 39/12 | 312/257.1 |
| 4,765,698 | A | 8/1988 | Dooley | | |
| 5,738,424 | A * | 4/1998 | Katz | D06F 39/12 | 312/293.3 |
| 6,119,678 | A | 9/2000 | Marchand | | |

* cited by examiner

*Primary Examiner* — Cristi J Tate-Sims
(74) *Attorney, Agent, or Firm* — Price Heneveld LLP

(57) ABSTRACT

A laundry appliance includes a cabinet that includes a front panel that defines an aperture. A user-interface assembly is positioned within the aperture and includes a retaining bracket assembly. The user-interface assembly is biased by a force of gravity toward an open rest position. A spring pin is selectively engaged with the retaining bracket assembly. The user-interface assembly is retained in a retained position by the engagement between the spring pin and the retaining bracket assembly. A spring bracket is coupled to an interior surface of the user-interface assembly. The spring bracket engages an inner surface of the front panel to stop the user-interface assembly in the open rest position when the retaining bracket assembly is released from engagement with the spring pin.

20 Claims, 10 Drawing Sheets

USER-INTERFACE ASSEMBLY FOR AN APPLIANCE

BACKGROUND OF THE DISCLOSURE

The present disclosure generally relates to a user-interface assembly, and more specifically, to a user-interface assembly for an appliance.

SUMMARY OF THE DISCLOSURE

According to one aspect of the present disclosure, a laundry appliance includes a cabinet that includes a front panel that defines an aperture. A user-interface assembly is positioned within the aperture and includes a retaining bracket assembly. The user-interface assembly is biased by a force of gravity toward an open rest position. A spring pin is selectively engaged with the retaining bracket assembly. The user-interface assembly is retained in a retained position by the engagement between the spring pin and the retaining bracket assembly. A spring bracket is coupled to an interior surface of the user-interface assembly. The spring bracket engages an inner surface of the front panel to stop the user-interface assembly in the open rest position when the retaining bracket assembly is released from the engagement with the spring pin.

According to another aspect of the present disclosure, a laundry appliance user-interface assembly includes a cabinet panel that defines an aperture. A user-interface is positioned within the aperture. A pin is selectively engaged with the user-interface. The user-interface is retained in a retained position when the pin is engaged with the user-interface. A spring bracket is coupled to an interior surface of the user-interface and engages an inner surface of the cabinet panel to stop the user-interface in an open rest position when the user-interface is released from an engagement with the spring pin.

According to yet another aspect of the present disclosure, a user-interface assembly for an appliance includes a panel that defines an aperture. The user-interface is positioned within the aperture and biased toward an open rest position by a force of gravity. The user-interface is configured to be retained in a retained position. A spring bracket is coupled to an interior surface of the user-interface. The spring bracket engages an inner surface of the panel to stop the user-interface in an open rest position when released from the retained position. A bracket arm is coupled to the interior surface of the user-interface. The user-interface is rotatable between the open rest position and an access position. The bracket arm selectively engages the cabinet to retain user-interface in the access position.

These and other features, advantages, and objects of the present disclosure will be further understood and appreciated by those skilled in the art by reference to the following specification, claims, and appended drawings.

Figure 1:
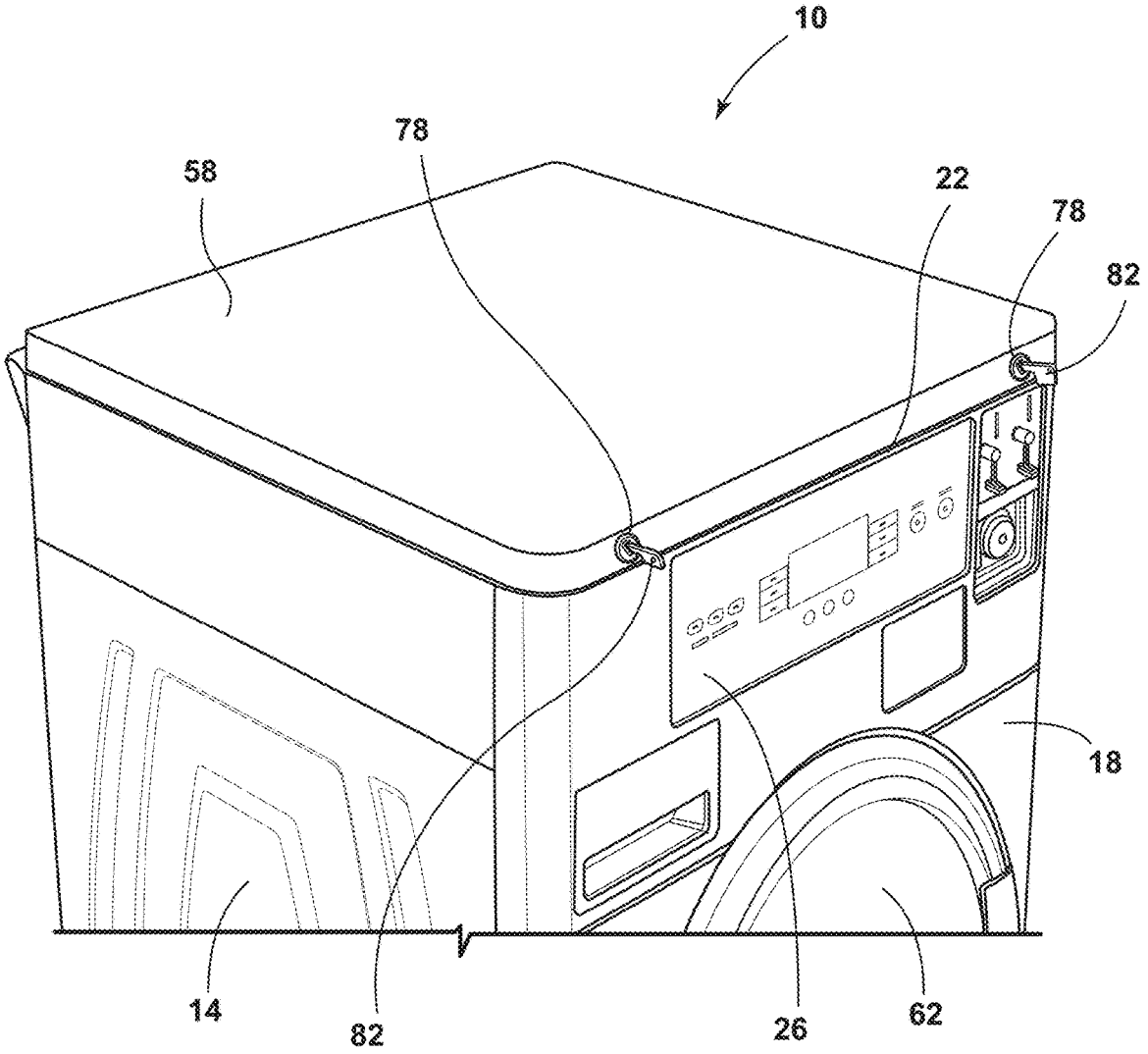
FIG. 1 is a front perspective view of an appliance with a lid in a lowered position, according to the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to a user-interface assembly for an appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-13, reference numeral 10 generally designates a laundry appliance that includes a cabinet 14 having a front panel 18 that defines an aperture 22. A user-interface assembly 26 is positioned within the aperture 22 and includes a retaining bracket assembly 30. The user-interface assembly 26 is biased by a force of gravity toward an open rest position 34. A spring pin 38 is selectively engaged with the retaining bracket assembly 30. The user-interface assembly 26 is retained in a retained position 42 by the engagement between the spring pin 38 and the retaining bracket assembly 30. A spring bracket 46 is coupled to an interior surface 50 of the user-interface assembly 26. The spring bracket 46 engages an inner surface 54 of the front panel 18 to stop the user-interface assembly 26 in the open rest position 34 when the retaining bracket assembly 30 is released from the engagement with the spring pin 38.

Figure 2:
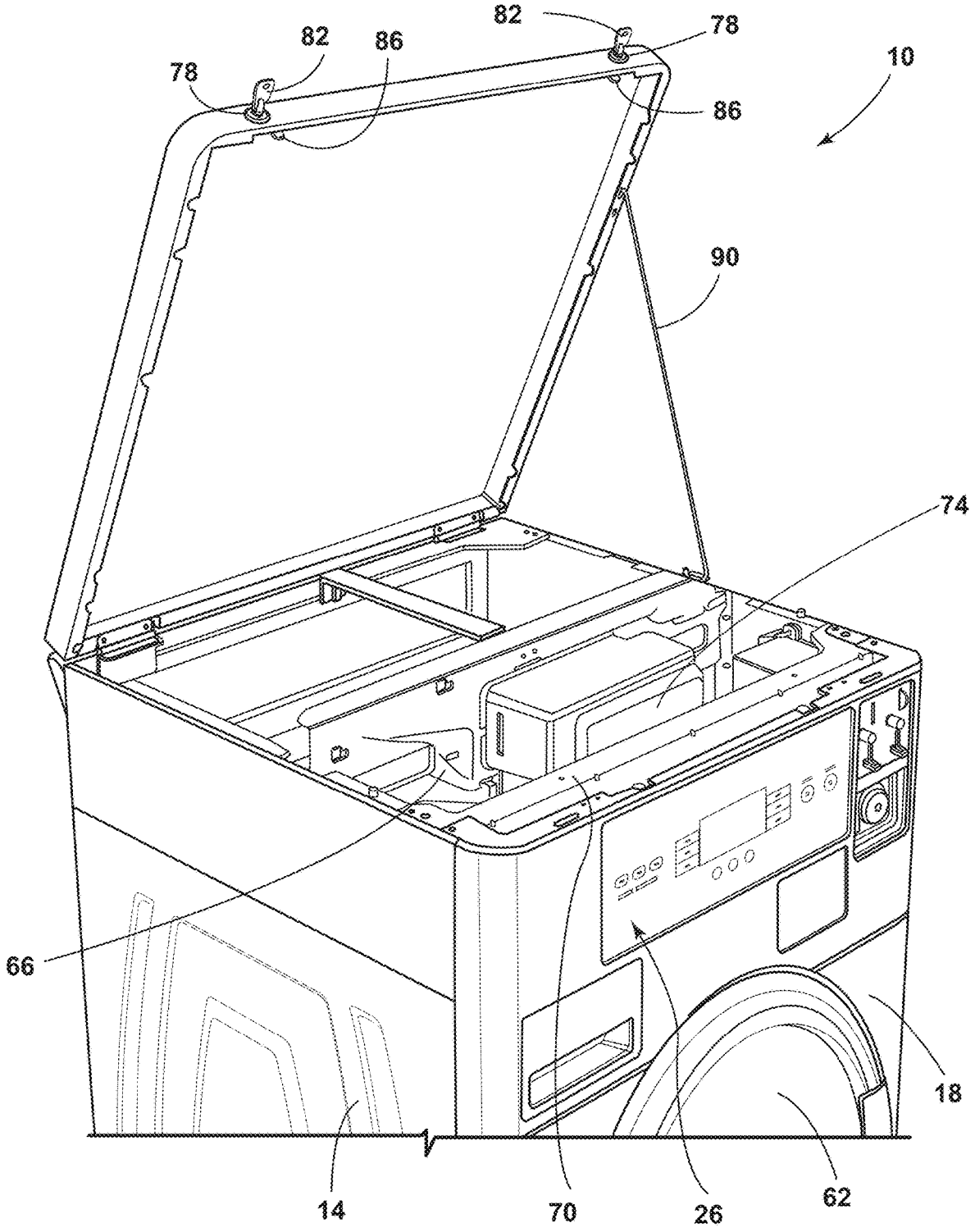
FIG. 2 is a front perspective view of the appliance of FIG. 1 with the lid in a raised position.

Referring to FIGS. 1 and 2, the laundry appliance 10 includes the cabinet 14 with a lid 58 and a door 62 coupled to the cabinet 14. The laundry appliance 10 is illustrated as a front-load laundry appliance 10. In such examples, the lid 58 may be configured as a top of the laundry appliance 10. The lid 58 is operable between opened and closed positions to conceal and provide access to an interior 66 of the cabinet 14. In various examples, a cross bar 70 may span a forward portion 74 of the cabinet 14 and may engage with the front panel 18. The user-interface assembly 26 is illustrated in FIG. 1 disposed on a laundry appliance 10; however, the user-interface assembly 26 may be included on other appliances, such as, a dishwasher, a stove, a refrigerating appliance, or other appliances and structures within a commercial or residential setting.

As illustrated in FIGS. 1 and 2, the laundry appliance 10 is a commercial appliance that may be configured to utilize a token to trigger operation of the laundry appliance 10. According to various aspects, the lid 58 may be positioned above the user-interface assembly 26. In such examples, the front panel 18 of the cabinet 14 may define the aperture 22 in which the user-interface assembly 26 is positioned. It is also contemplated that the user-interface assembly 26 may be coupled to another panel of the cabinet 14 or an upper console extension on a top of the cabinet 14 without departing from the teachings herein.

The lid 58 may define a lock 78 with which a key 82 may engage to release the lid 58 from the cabinet 14. As illustrated in FIGS. 1 and 2, the lid 58 includes two locks 78, such that two keys 82 are used to unlock the lid 58 by rotating respective locking protrusions 86 to disengage the cabinet 14. The lid 58 is operable between the raised and lowered positions. The lid 58 may be supported by a pivotable brace 90 in the raised position, as illustrated in FIG. 2. Although illustrated in an upward direction in FIGS. 1 and 2, it is contemplated that the lid 58 may be positioned along the cabinet 14 in various locations, such that the raised position may correspond with a lateral opening of the lid 58, as well as a vertical opening of the lid 58.

Figure 3:
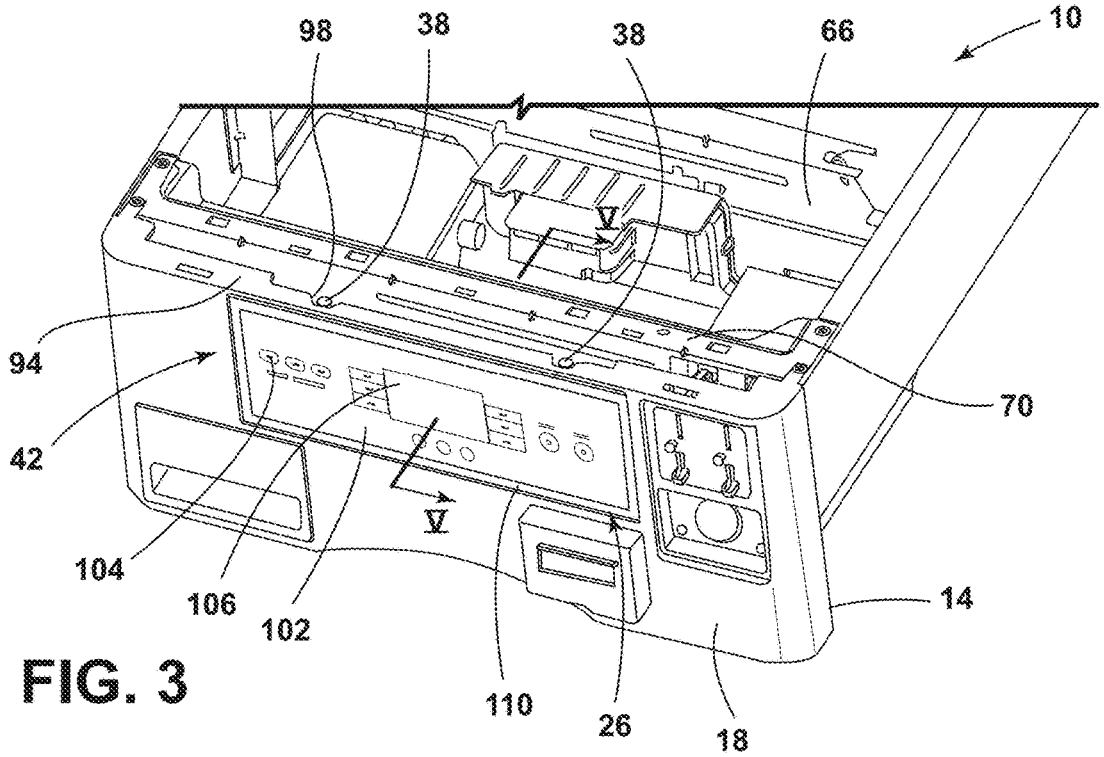
FIG. 3 is a front perspective view of a user-interface assembly for a laundry appliance in a retained position, according to the present disclosure.
Figure 4:
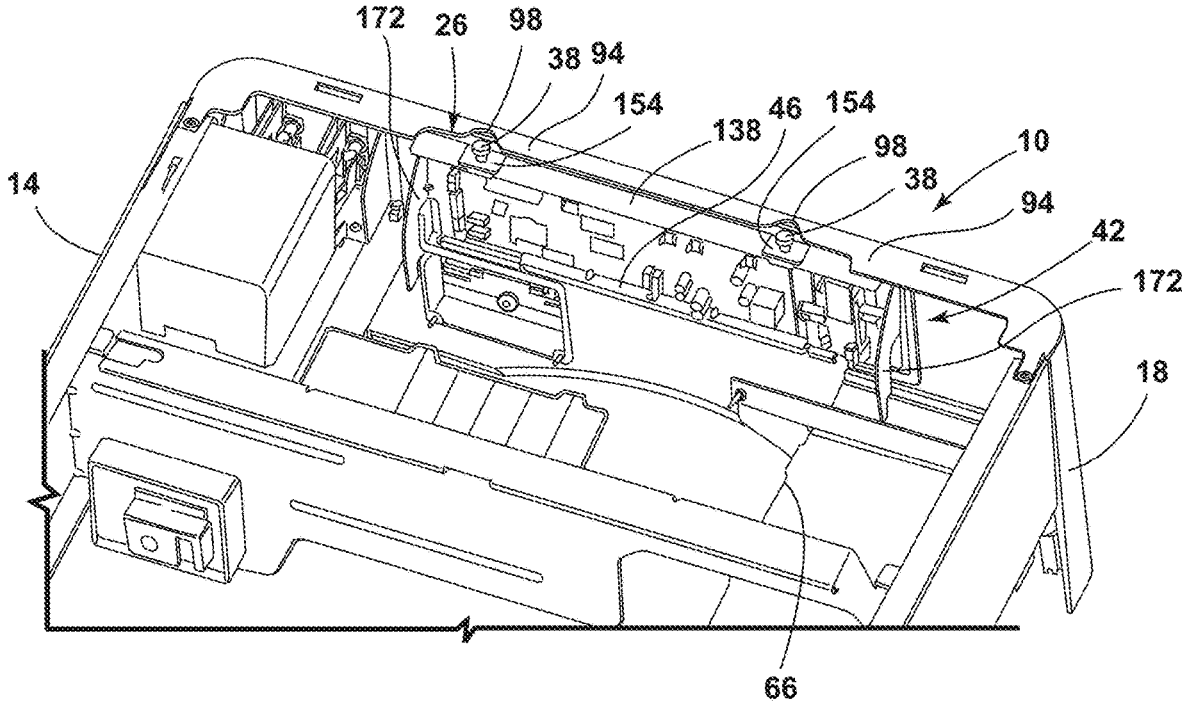
FIG. 4 is a rear perspective view of the user-interface assembly of FIG. 3, with the cross bar removed.

Referring to FIGS. 3 and 4, the user-interface assembly 26 is illustrated in the retained position 42. When in the retained position 42, the user-interface assembly 26 is disposed substantially parallel to the front panel 18. In various examples, the user-interface assembly 26 may align and/or be flush with the front panel 18, or alternatively, may be offset from the front panel 18. The front panel 18 may define an edge extension 94 that extends inward from the front panel 18 toward the interior 66 of the cabinet 14. The edge extension 94 may engage the cross bar 70 to increase structural support of the cabinet 14. The edge extension 94 may define grooves 98 to accommodate the spring pin 38. The grooves 98 may provide space for movement of the spring pin 38. In various examples, as illustrated in FIG. 4, the laundry appliance 10 may include two spring pins 38 that engage the user-interface assembly 26.

According to various aspects, the user-interface assembly 26 includes a user-interface 102 and is configured to receive an input from a user. The user-interface 102 may include tactile features 104, such as buttons, dials, or a touch panel for receiving the user input. Additionally or alternatively, the user-interface 102 may include a display screen 106 to provide visual confirmation to the user of the user input. The user-interface assembly 26 may also include a support panel 110. In various examples, the user-interface 102 is disposed on the support panel 110. Visual and auditory interface mechanisms may also be included.

Figure 5:
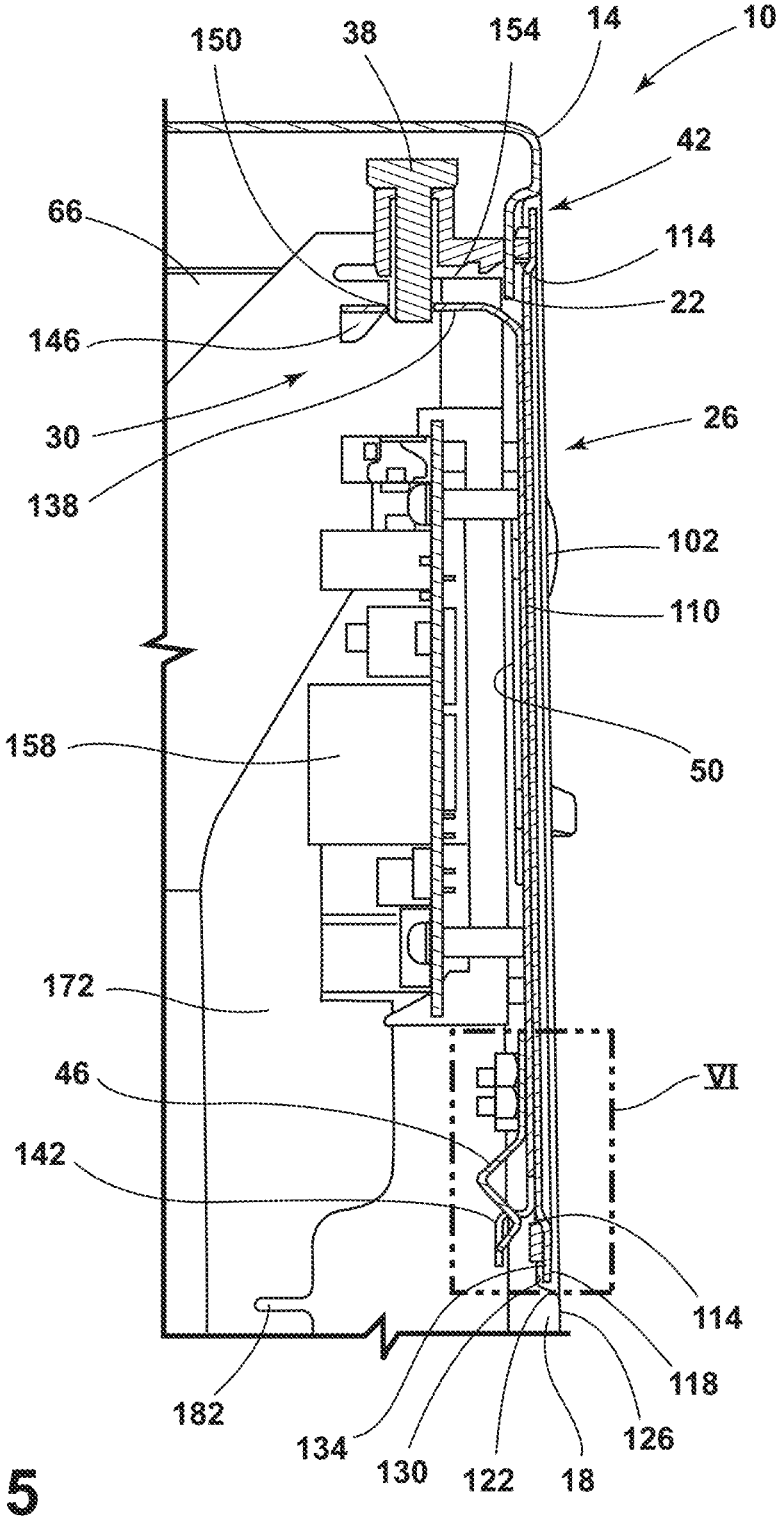
FIG. 5 is a cross-sectional view of the user-interface assembly of FIG. 3, taken along line V-V.
Figure 6:
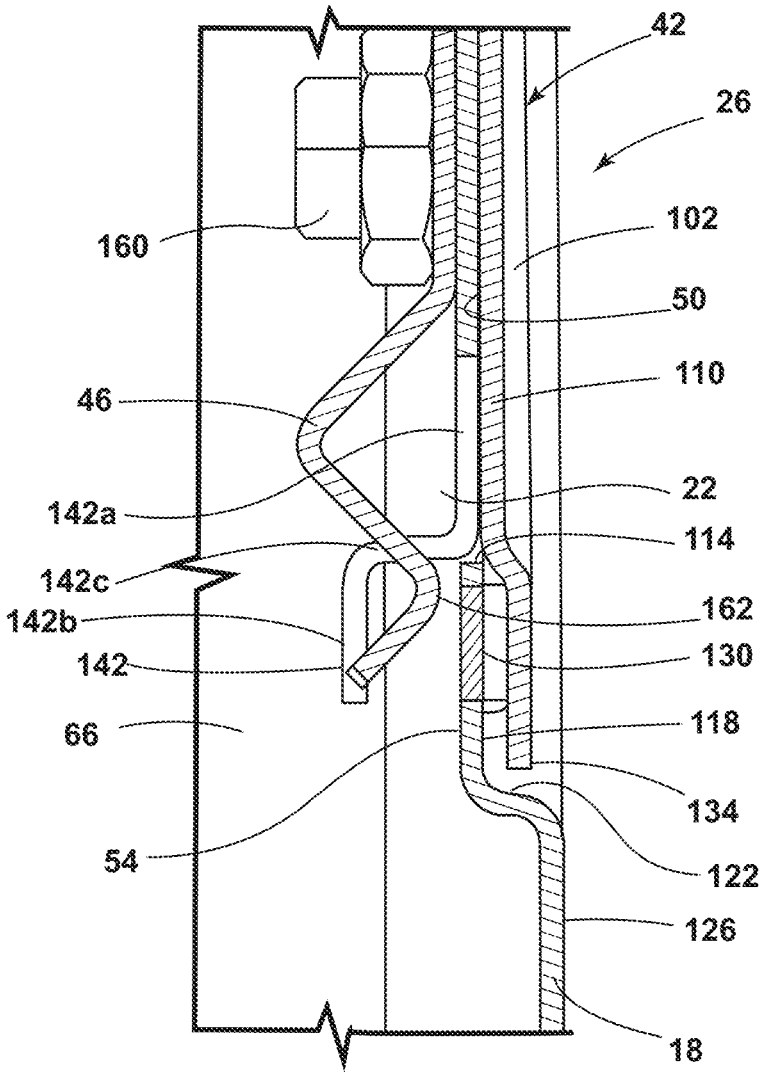
FIG. 6 is an enlarged view of an interface between the user-interface assembly and a cabinet of FIG. 5, taken at area VI.

Referring to FIGS. 4-6, the user-interface assembly 26 covers at least a portion of the aperture 22 when in the retained position 42. The support panel 110 typically extends beyond an edge 114 of the cabinet 14 that defines the aperture 22. In various examples, the front panel 18 defines an indent 118 proximate the aperture 22. As illustrated in FIG. 5, the indent 118 is disposed proximate the edge 114 that defines the aperture 22. In this way, the user-interface assembly 26 may be set back from an outer surface 126 of the front panel 18. The cabinet 14 may define a ledge 122 extending between the outer surface 126 of the front panel 18 and an indent surface 130 of the front panel 18. An end 134 of the support panel 110 may extend into a space within the indent 118 and be disposed proximate the ledge 122 when the user-interface assembly 26 is in the retained position 42.

According to various aspects, the user-interface assembly 26 includes the retaining bracket assembly 30. The retaining bracket assembly 30 may include upper and lower retaining brackets 138, 142. The upper retaining bracket 138 may extend from the interior surface 50 of the user-interface assembly 26 toward the interior 66 of the cabinet 14. In various examples, the upper retaining bracket 138 extends substantially perpendicular to the support panel 110. The upper retaining bracket 138 may extend all, or a substantial portion of, a length of the user-interface assembly 26. In this way, the upper retaining bracket 138 may extend between the side edges 114 that define the aperture 22. The upper retaining bracket 138 may include an end ramp 146 having an increased thickness for engaging the spring pin 38. Additionally or alternatively, the end ramp 146 may elastically deform to guide the spring pin 38 to a receiving hole 150. The upper retaining bracket 138 may define the receiving hole 150 configured to receive the spring pin 38. In examples with two spring pins 38, the upper retaining bracket 138 may define a corresponding number of receiving holes 150. The end ramp 146 may be advantageous for automatically engaging the spring pin 38 when the user-interface assembly 26 is moved to the retained position 42. It is also contemplated that the upper retaining bracket 138 may engage a fastener, a pin, or other coupling feature to retain the user-interface assembly 26 in the retained position 42. According to various aspects, the cabinet 14 may define support tabs 154 that extend inward from the edge extension 94 to support the spring pins 38. In this way, the spring pins 38 may be coupled to the support tabs 154 and extend therethrough to engage the upper retaining bracket 138.

The user-interface assembly 26 includes a service panel 158 coupled to the interior surface 50 thereof. The service panel 158 includes various controls for the user-interface 102 and a Wi-Fi module. When the user-interface assembly 26 is in the retained position 42, the service panel 158 faces the interior 66 of the cabinet 14. In this way, the service panel 158 may be inaccessible or difficult to access when the user-interface assembly 26 is in the retained position 42.

Referring to FIGS. 5 and 6, the retaining bracket assembly 30 may include the lower retaining bracket 142. The lower retaining bracket 142 is coupled to the interior surface 50 of the support panel 110 proximate the end 134. The lower retaining bracket 142 may abut the edge 114 that defines the aperture 22 when the user-interface assembly 26 is in the retained position 42. In various examples, at least a portion of the lower retaining bracket 142 extends away from the interior surface 50 of the support panel 110. As illustrated in FIGS. 5 and 6, the lower retaining bracket 142 includes two end portions 142*a*, 142*b* arranged substantially parallel to one another and connected by a middle portion 142*c* extending at an angle therebetween. However, it is contemplated that the lower retaining bracket 142 may have any practicable configuration to form a space for engaging the edge 114 in cooperation with the support panel 110.

Referring to FIG. 6, the user-interface assembly 26 includes the spring bracket 46 coupled to the interior surface 50. As illustrated in FIG. 6, the spring bracket 46 may be coupled to the lower retaining bracket 142, and the lower retaining bracket 142 may be coupled to the support panel 110. The spring bracket 46 may be mechanically fastened to the lower retaining bracket 142 and/or the support panel 110 by a fastener 160. According to various aspects, the spring bracket 46 may have a zig-zag configuration. The zig-zag configuration may provide for an engagement portion 162 to be configured to engage the inner surface 54 of the front panel 18. However, the spring bracket 46 may have any practicable configuration. As illustrated in FIG. 6, the spring bracket 46 may be spaced-apart from the inner surface 54 when the user-interface assembly 26 is moved into the retained position 42. Though spaced-apart, the engagement portion 162 may align with the edge 114 of the front panel 18 that defines the aperture 22. Accordingly, when the user-interface assembly 26 is in the retained position 42, the lower retaining bracket 142 may engage the cabinet 14 and the spring bracket 46 may be spaced-apart from the cabinet 14. In various examples, as best illustrated in FIG. 4, the spring bracket 46 may extend at least a portion of the length of the user-interface assembly 26. This configuration may be advantageous for providing increased surface area between the spring bracket 46 and the cabinet 14 when the spring bracket 46 engages the cabinet 14.

Figure 7:
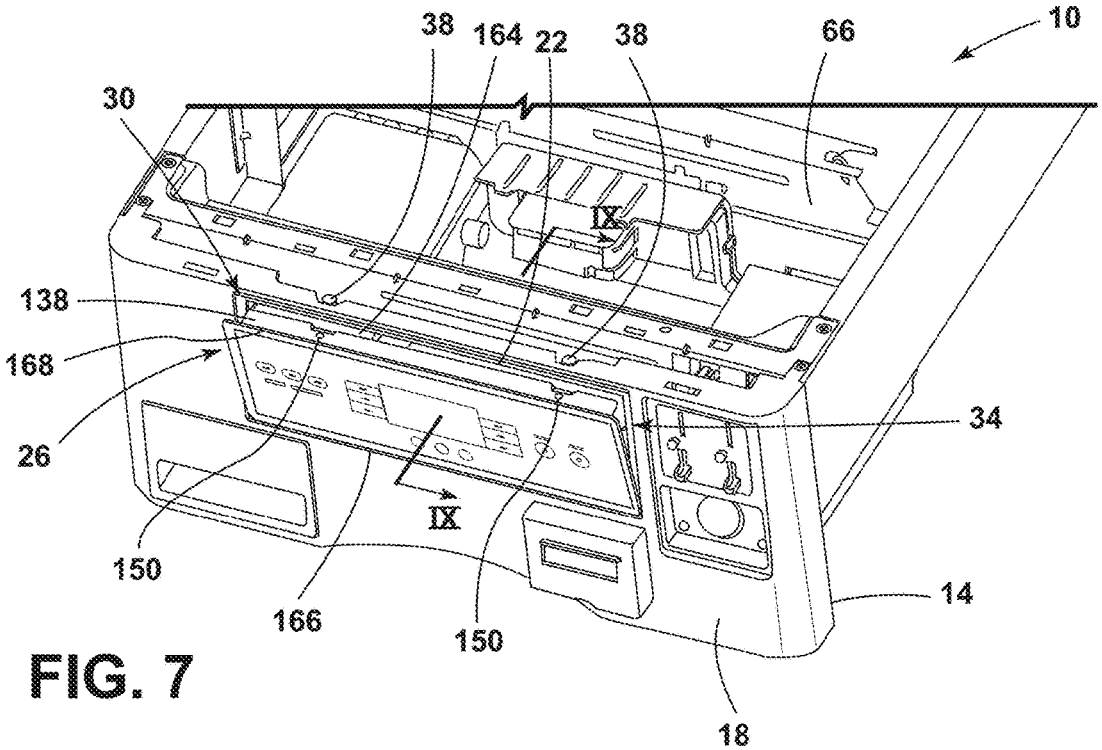
FIG. 7 is a front perspective view of a user-interface assembly for a laundry appliance in an open rest position, according to the present disclosure.

Referring to FIGS. 3 and 7, the user-interface assembly 26 is operable between the retained position 42 and the open rest position 34. According to various aspects, the user-interface assembly 26 is biased toward the open rest position 34 by the force of gravity. In this way, the user-interface assembly 26 may be weighted or otherwise configured to automatically rotate to the open rest position 34. Additionally or alternatively, a minimal manual force in conjunction with the force of gravity may cause the user-interface assembly 26 to rotate to the open rest position 34. The minimal manual force may be, for example, an outward and/or downward force on the user-interface assembly 26 relative to the cabinet 14. The spring pin 38 engages the upper retaining bracket 138 to retain the user-interface assembly 26 in the retained position 42. The engagement between the spring pin 38 and the upper retaining bracket 138 overcomes the biasing force to retain the user-interface assembly 26 in the retained position 42. When the engagement between the spring pin 38 and the upper retaining bracket 138 of the retaining bracket assembly 30 is released, the user-interface assembly 26 automatically rotates, or falls in a controlled manner, to the open rest position 34. Stated differently, the spring pin 38 selectively engages the upper retaining bracket 138 to secure the user-interface assembly 26 in the retained position 42, and the user-interface assembly 26 moves to the open rest position 34 when the upper retaining bracket 138 is released from the engagement with the spring pin 38.

Figure 8:
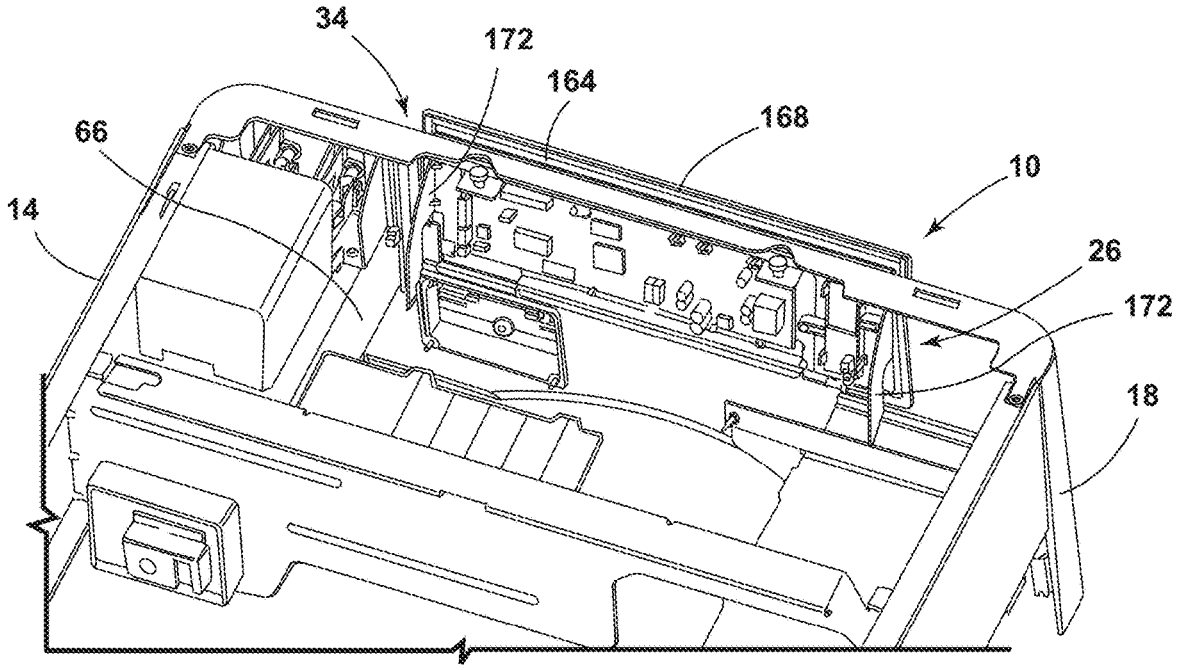
FIG. 8 is a rear perspective view of the user-interface assembly of FIG. 7.

Referring to FIGS. 7 and 8, the user-interface assembly 26 is illustrated in the open rest position 34. The user-interface assembly 26 and the front panel 18 may define a grasping space 164 therebetween when the user-interface assembly 26 is in the open rest position 34. When in the open rest position 34, a lower edge 166 of the user-interface assembly 26 may remain engaged with the cabinet 14 and an upper edge 168 of the user-interface assembly 26 may be spaced-apart from the cabinet 14. In this way, the grasping space 164 may be defined between the front panel 18 of the cabinet 14 and the upper edge 168 of the user-interface assembly 26. Additionally or alternatively, when the user-interface assembly 26 is in the open rest position 34, the spring pin 38 does not engage the upper retaining bracket 138. The user-interface assembly 26 may be disposed at an angle in a range of from about 5° to about 30° relative to the front panel 18 when in the open rest position 34. Stated differently, the user-interface assembly 26 and the front panel 18 define an angle in a range of from about 5° to about 30° therebetween when the user-interface assembly 26 is in the open rest position 34.

Figure 9:
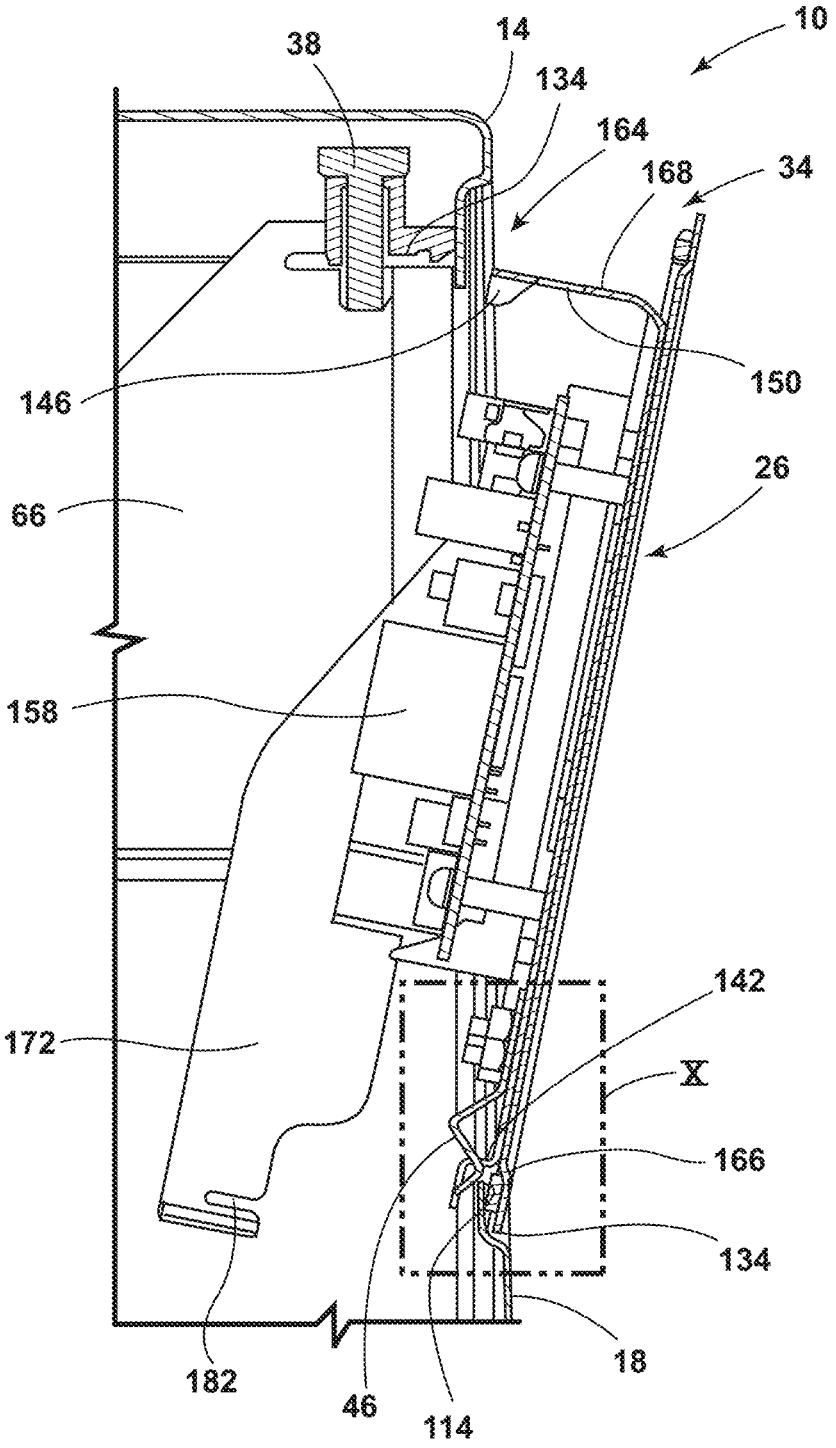
FIG. 9 is a cross-sectional view of the user-interface assembly of FIG. 7, taken along line IX-IX.
Figure 10:
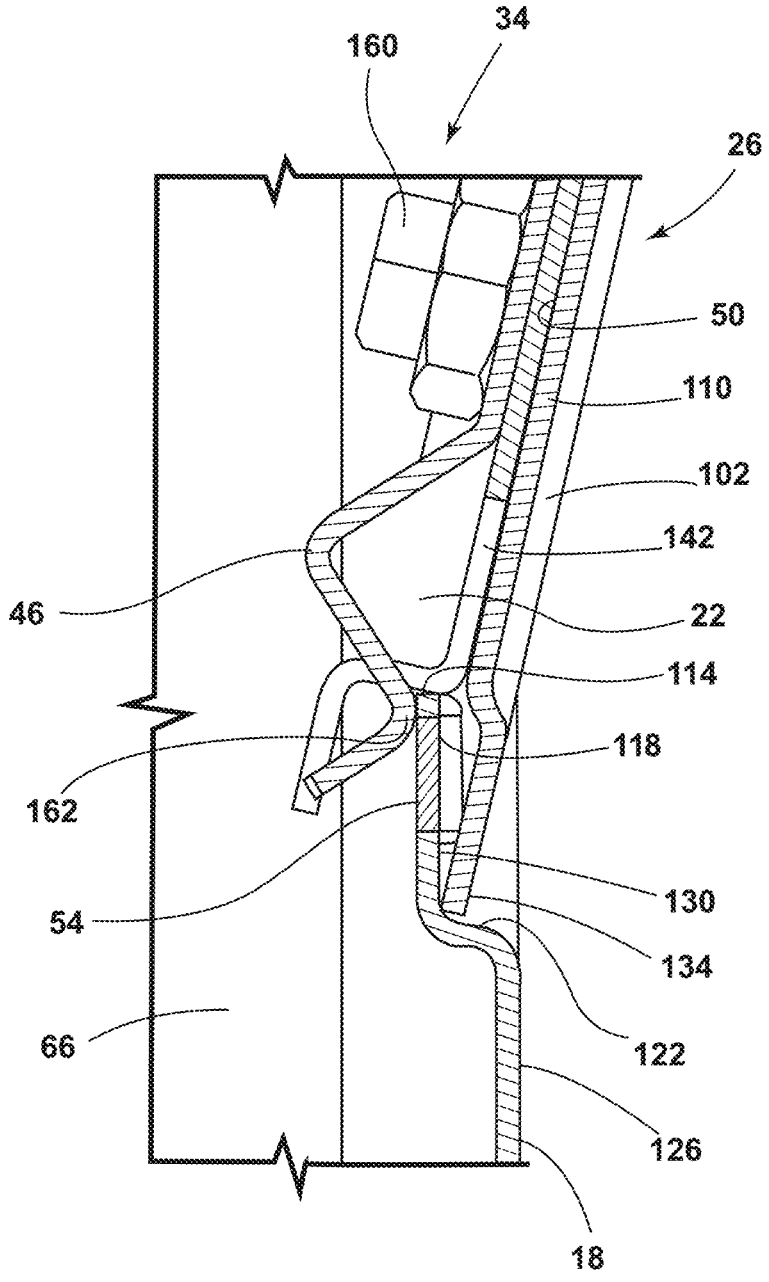
FIG. 10 is an enlarged view of an interface between the user-interface assembly and a cabinet of FIG. 9, taken at area X.

Referring to FIGS. 8-10, the user-interface assembly 26 may extend away from the front panel 18 when in the open rest position 34. The upper retaining bracket 138 is disengaged from the spring pin 38. The lower retaining bracket 142 may remain engaged with the edge 114 of the cabinet 14 that defines the aperture 22. In this way, the lower retaining bracket 142 may pivot about the edge 114 as the user-interface assembly 26 rotates about the point of engagement between the edge 114 of the cabinet 14 and the support panel 110, the lower retaining bracket 142, and the spring bracket 46 of the user-interface assembly 26 between the retained position 42 and the open rest position 34.

According to various aspects, the end 134 of the support panel 110 may engage the indent surface 130 proximate the ledge 122 when the user-interface assembly 26 is in the open rest position 34. The end 134 may, additionally or alternatively, engage the ledge 122 when the user-interface assembly 26 is in the open rest position 34. The engagement between the end 134 of the support panel 110 and the indent surface 130 may contribute to the stopping of the user-interface assembly 26 in the open rest position 34 when the engagement between the spring pin 38 and the upper retaining bracket 138 is released. In various examples, the engagement portion 162 of the spring bracket 46 engages the inner surface 54 of the front panel 18 of the cabinet 14 when the user-interface assembly 26 is in the open rest position 34. In this way, the spring bracket 46 engages the inner surface 54 to stop the user-interface assembly 26 in the open rest position 34 when the retaining bracket assembly 30 is released from the engagement with the spring pin 38. The engagement portion 162 may engage the inner surface 54 proximate the edge 114 of the cabinet 14 that defines the aperture 22. The spring bracket 46 and/or the end 134 of the support panel 110 may stop and/or retain the user-interface assembly 26 in the open rest position 34 when the user-interface assembly 26 is released from the retained position 42. Additionally, the spring bracket 46 may prevent the user-interface assembly 26 from moving to an access position 170 (FIG. 11) when the user-interface assembly 26 is released from the retained position 42.

Referring to FIGS. 1-10, a user or technician may desire to access to the service panel 158 coupled to the interior surface 50 of the user-interface assembly 26. The user can unlock the lid 58 by the lock 78 and the key 82, and rotate the lid 58 from the lowered position to the raised position. The user may then move the spring pins 38, such that the spring pins 38 disengage from the upper retaining bracket 138, thereby releasing the user-interface assembly 26 from the retained position 42. The user-interface assembly 26 then rotates by the force of gravity to the open rest position 34. The open rest position 34 may be advantageous such that the user will not typically have to catch the user-interface assembly 26 from falling after disengagement of the spring pins 38.

Figure 11:
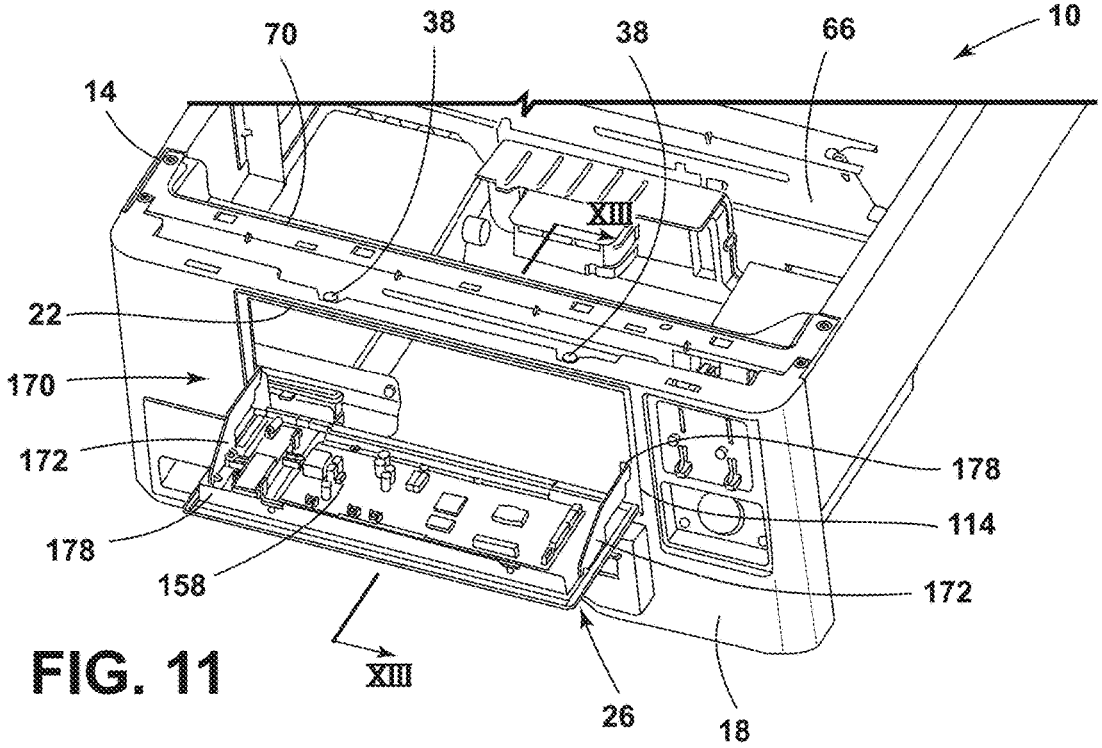
FIG. 11 is a front perspective view of the user-interface assembly for a laundry appliance in an access position, according to the present disclosure.
Figure 12:
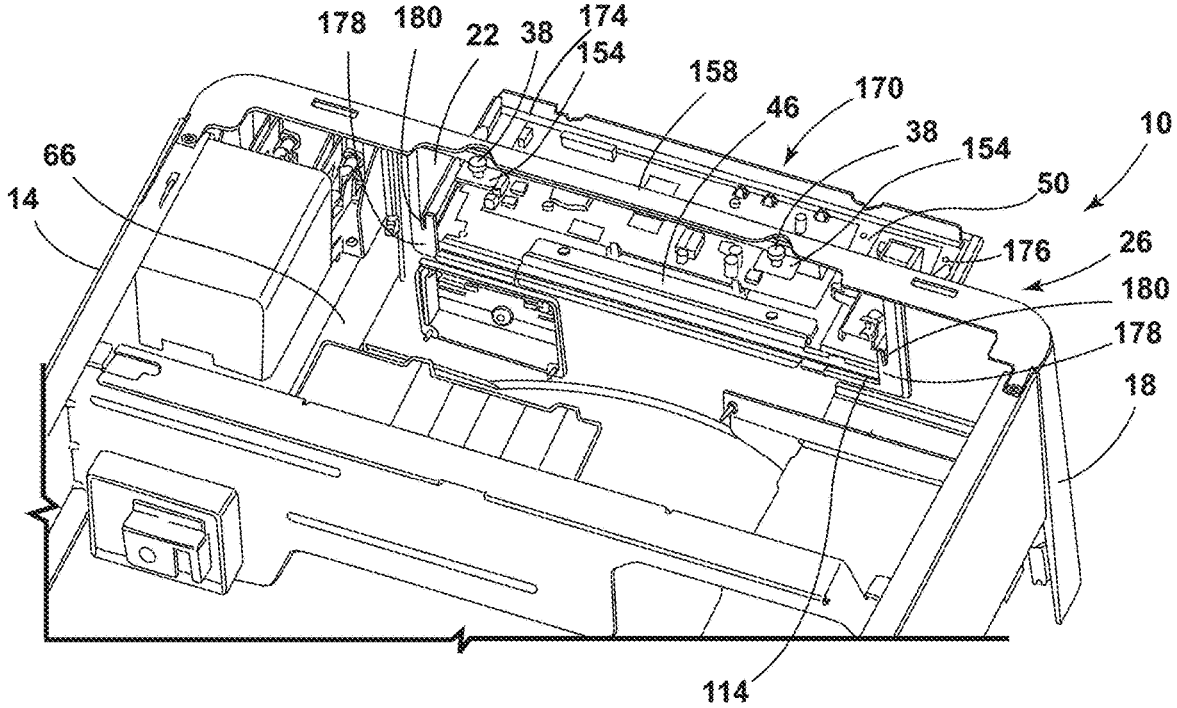
FIG. 12 is a rear perspective view of the user-interface assembly of FIG. 11.

Referring to FIGS. 11 and 12, the user-interface assembly 26 is rotatable to the access position 170. When in the access position 170, the user or technician may gain access to the service panel 158 coupled to the interior surface 50 of the user-interface assembly 26. The user or technician may lift and/or rotate the user-interface panel 26 from the open rest position 34 (FIG. 3) to the access position 170. In the access position 170, the user-interface assembly 26 may extend substantially perpendicularly from the front panel 18 of the cabinet 14. According to various aspects, the user-interface assembly 26 includes a bracket arm 172 coupled to the interior surface 50 of the user-interface assembly 26. As illustrated in FIGS. 11 and 12, the user-interface assembly 26 includes two bracket arms 172 coupled to first and second sides 174, 176 of the user-interface assembly 26, respectively. The bracket arms 172 engage the cabinet 14 proximate the edge 114 that defines the aperture 22 to retain the user-interface assembly 26 in the access position 170.

Figure 13:
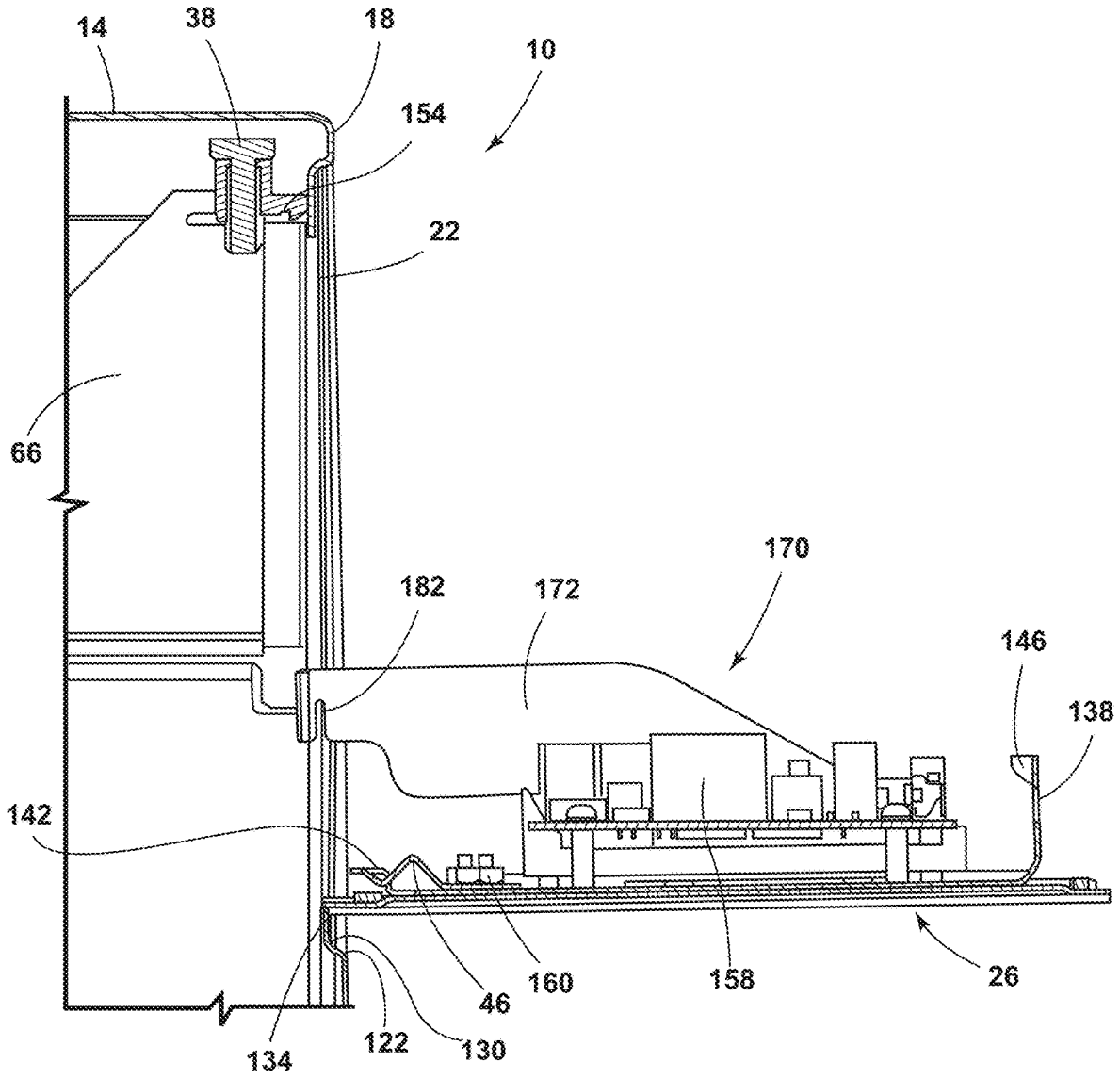
FIG. 13 is a cross-sectional view of the user-interface assembly of FIG. 11, taken along line XIII-XIII.

Referring to FIGS. 12 and 13, the bracket arm 172 may engage a flange 178 defined by the cabinet 14. In examples with two bracket arms 172, the cabinet 14 may define two flanges 178 to correspond with the two bracket arms 172. The flange 178 may extend from the edge 114 of the cabinet 14 inward towards and/or into the aperture 22. In various examples, the flange 178 may define a flange slot 180. As illustrated in FIGS. 12 and 13, the flange slot 180 may extend from an upper edge of the flange 178 and extend substantially vertical therethrough. However, other practicable configurations of the flange 178 are contemplated without departing from the teachings herein. The bracket arm 172 may define a bracket slot 182. The bracket slot 182 typically extends from a lower edge of the bracket arm 172. When the user-interface assembly 26 is in the access position 170, the bracket slot 182 may be substantially parallel to the flange slot 180 to allow for an interlocking engagement. In this way, the bracket arm 172 may fit over the flange 178 aligning the flange slot 180 and the bracket slot 182. In this way, the bracket arm 172 may interlock with the flange 178 to retain the user-interface assembly 26 in the access position 170. Once retained in the access position 170, the user or technician may have access to the service panel 158 to conduct any service and/or repair work.

Referring to FIGS. 7-13, the user-interface assembly 26 is biased toward the open rest position 34. The spring bracket 46 retains the user-interface assembly 26 in the open rest position 34. The user or technician can rotate the user-interface assembly 26 to the access position 170. Additionally or alternatively, the user can engage the bracket arm 172 with the flange 178 to retain the user-interface assembly 26 in the access position 170. When in the access position 170, the end 134 of the support panel 110 may abut the indent surface 130 proximate the edge 114 of the cabinet 14 defining the aperture 22. The end 134 may be spaced-apart from the ledge 122, as illustrated in FIG. 13. Alternatively, the support panel 110 may rest on the ledge 122 when the user-interface assembly 26 is in the access position 170. An engagement between the end 134 and the ledge 122 may provide additional support to the user-interface assembly 26 when in the access position 170.

Referring to FIGS. 1-13, in operation, the user or technician can disengage the spring pin 38 from the upper retaining bracket 138. The disengagement releases the user-interface assembly 26 to rotate to the open rest position 34 from the retained position 42. The cabinet 14 and the user-interface assembly 26 may define the grasping space 164 when in the open rest position 34. The user or technician can utilize the grasping space 164 to rotate the user-interface assembly 26 from the open rest position 34 to the access position 170. The engagement between the bracket arm 172 and the flange 178 of the cabinet 14 retains the user-interface assembly 26 in the access position 170, such that the user or technician can access and/or service the service panel 158. The user or technician can return the user-interface assembly 26 to the retained position 42 by disengaging the bracket arm 172 from the flange 178. The user or technician can rotate the user-interface assembly 26 from the access position 170 past the open rest position 34 to the retained position 42. The end ramp 146 of the upper retaining bracket 138 may automatically engage the spring pin 38. The spring pin 38 may be guided into the receiving hole 150 of the upper retaining bracket 138, thereby retaining the user-interface assembly 26 in the retained position 42. The user or technician may then return the lid 58 to the lowered position and lock the lid 58 in the lowered position with the lock 78 and the key 82.

Use of the present disclosure may provide a variety of advantages. For example, the user-interface assembly 26 may be biased by the force of gravity to the open rest position 34. Additionally, when the engagement between the spring pin 38 and the upper retaining bracket 138 is released, the user-interface assembly 26 may automatically rotate to the open rest position 34. Also, the spring bracket 46 may stop and/or retain the user-interface assembly 26 in the open rest position 34. Further, the open rest position 34 may prevent the user-interface assembly 26 from falling when the engagement between the spring pin 38 and the upper retaining bracket 138 is released. Moreover, the user-interface assembly 26 and the cabinet 14 may define the grasping space 164 therebetween when the user-interface assembly 26 is in the open rest position 34. The user or technician can then rotate the user-interface assembly 26 to the access position 170 and access the service panel 158. Additional benefits or advantages of using this device may also be realized and/or achieved.

According to at least one aspect of the present disclosure, a laundry appliance includes a cabinet that includes a panel that defines an aperture. The user-interface assembly is positioned within the aperture and includes a retaining bracket assembly. The user-interface assembly is biased by a force of gravity toward an open rest position. A spring pin is selectively engaged with the retaining bracket assembly. The user-interface assembly is retained in a retained position by the engagement between the spring pin and the retaining bracket assembly. A spring bracket is coupled to an interior surface of the user-interface assembly. The spring bracket engages an inner surface of the front panel to stop the user-interface assembly in the open rest position when the retaining bracket assembly is released from the engagement with the spring pin.

According to another aspect, a retaining bracket assembly includes upper and lower retaining brackets coupled to an interior surface of the user-interface assembly.

According to still another aspect, an upper retaining bracket defines a receiving hole for selectively receiving a spring pin.

According to yet another aspect, a lower retaining bracket abuts an edge defining an aperture when a user-interface assembly is in a retained position.

According to another aspect, a lower retaining bracket pivots about an edge as a user-interface assembly rotates between a retained position and an open rest position.

According to still another aspect, a front panel defines an indent that has a ledge proximate an aperture. A user-interface assembly includes a support panel having an end that extends into the indent.

According to another aspect, an end of the support panel abuts an edge when a user-interface assembly is in an open rest position.

According to at least one aspect of the present disclosure, a laundry appliance user-interface assembly includes a cabinet panel that defines an aperture. A user-interface is positioned within the aperture. A pin is selectively engaged with the user-interface. The user-interface is retained in a retained position when the pin is engaged with the user-interface. The spring bracket is coupled to the interior surface of the user-interface and engages an inner surface of the cabinet panel to stop the user-interface in an open rest position when the user-interface is released from the engagement with the pin.

According to another aspect, the user-interface is biased toward an open rest position by a force of gravity.

According to still another aspect, a bracket arm is coupled to an interior surface of a user-interface.

According to another aspect, a cabinet defines a flange that extends from an edge into an aperture.

According to yet another aspect, a user-interface is rotatable between an open rest position and an access position. A bracket arm engages a flange to retain the user-interface in the access position.

According to another aspect, a user-interface is substantially parallel to a cabinet panel when in a retained position.

According to still another aspect, a user-interface and a cabinet panel define a grasping space therebetween when the user-interface is in an open rest position.

According to another aspect, a user-interface defines an angle in a range of from about 5° to about 30° relative to a cabinet panel when the user-interface is in an open rest position.

According to at least one aspect of the present disclosure, a user-interface assembly for an appliance includes a panel that defines an aperture. The user-interface is positioned within the aperture and biased toward an open rest position by a force of gravity. The user-interface is configured to be retained in a retained position. A spring bracket is coupled to an interior surface of the user-interface. The spring bracket engages an inner surface of the panel to stop the user-interface in an open rest position when released from the retained position. A bracket arm is coupled to an interior surface of the user-interface. The user-interface is rotatable between the open rest position and an access position. A bracket arm selectively engages the panel to retain the user-interface in the access position.

According to another aspect, a retaining bracket assembly is coupled to an interior surface of the user-interface. The retaining bracket assembly includes an upper retaining bracket and a lower retaining bracket.

According to still another aspect, a spring pin selectively engages an upper retaining bracket to secure a user-interface in a retained position. The user-interface moves to an open rest position when the upper retaining bracket is released from an engagement with a spring pin.

According to yet another aspect, a lower retaining bracket engages an edge that defines an aperture when a user-interface rotates between a retained position and an open rest position.

According to another aspect, a panel defines a flange that extends from an edge that defines an aperture. A bracket arm defines a bracket slot that engages a flange slot of the flange to retain the user-interface in an access position.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A laundry appliance, comprising:

a cabinet including a front panel defining an aperture;

a user-interface assembly positioned within the aperture and including a retaining bracket assembly, wherein the user-interface assembly is biased by a force of gravity toward an open rest position;

a spring pin selectively engaged with the retaining bracket assembly, wherein the user-interface assembly is retained in a retained position by the engagement between the spring pin and the retaining bracket assembly;

a spring bracket coupled to an interior surface of the user-interface assembly, wherein the spring bracket engages an inner surface of the front panel to stop and hold the user-interface assembly in the open rest position when the retaining bracket assembly is released from the engagement with the spring pin; and a bracket arm coupled to the user-interface assembly and configured to engage the cabinet to hold the user-interface assembly in an access position.

2. The laundry appliance of claim 1, wherein the retaining bracket assembly includes upper and lower retaining brackets coupled to an interior surface of the user-interface assembly.

3. The laundry appliance of claim 2, wherein the upper retaining bracket defines a receiving hole for selectively receiving the spring pin.

4. The laundry appliance of claim 2, wherein the lower retaining bracket abuts an edge defining the aperture when the user-interface assembly is in the retained position.

5. The laundry appliance of claim 4, wherein the lower retaining bracket pivots about the edge as the user-interface assembly rotates between the retained position and the open rest position.

6. The laundry appliance of claim 1, wherein the front panel defines an indent having a ledge proximate the aperture, and wherein the user-interface assembly includes a support panel having an end that extends into the indent.

7. The laundry appliance of claim 6, wherein the end of the support panel abuts the ledge when the user-interface assembly is in the open rest position.

8. A laundry appliance user-interface assembly, comprising:

a cabinet panel defining an aperture;

a user-interface positioned within the aperture, wherein the user-interface is operable between a retained position, an open rest position, and an access position;

a pin selectively engaged with the user-interface, wherein the user-interface is retained in the retained position when the pin is engaged with the user-interface;

a spring bracket coupled to an interior surface of the user-interface and engaging an inner surface of the cabinet panel to stop and hold the user-interface in the open rest position when the user-interface is released from engagement with the pin; and a bracket arm coupled to the user-interface and configured to engage the cabinet panel to hold the user-interface in the access position.

9. The laundry appliance user-interface assembly of claim 8, wherein the user-interface is biased towards the open rest position by a force of gravity.

10. The laundry appliance user-interface assembly of claim 8, wherein the bracket arm is coupled to the interior surface of the user-interface.

11. The laundry appliance user-interface assembly of claim 10, wherein the cabinet panel defines a flange extending from an edge into the aperture.

12. The laundry appliance user-interface assembly of claim 11, wherein the user-interface is rotatable between the open rest position and the access position, and wherein the bracket arm engages the flange to retain the user-interface in the access position.

13. The laundry appliance user-interface assembly of claim 8, wherein the user-interface is substantially parallel to the cabinet panel when in the retained position.

14. The laundry appliance user-interface assembly of claim 8, wherein the user-interface and the cabinet panel define a grasping space therebetween when the user-interface is in the open rest position.

15. The laundry appliance user-interface assembly of claim 14, wherein the user-interface defines an angle in a range of from about 5° to about 30° relative to the cabinet panel when the user-interface is in the open rest position.

16. A user-interface assembly for an appliance, comprising:

a panel defining an aperture;

a user-interface positioned within the aperture and biased toward an open rest position by a force of gravity, wherein the user-interface is configured to be retained in a retained position;

a spring bracket coupled to an interior surface of the user-interface, wherein the spring bracket engages an inner surface of the panel to stop the user-interface in the open rest position when released from the retained position, wherein the spring bracket is configured to hold the user-interface at a first angle relative to the panel in the open rest position; and a bracket arm coupled to the interior surface of the user-interface, wherein the user-interface is rotatable between the open rest position and an access position, and wherein the bracket arm selectively engages the panel to retain the user-interface in the access position, and wherein the bracket arm is configured to hold the user-interface at a second angle relative to the panel in the access position, the second angle being larger than the first angle.

17. The user-interface assembly of claim 16, further comprising:

a retaining bracket assembly coupled to the interior surface of the user-interface, wherein the retaining bracket assembly includes an upper retaining bracket and a lower retaining bracket.

18. The user-interface assembly of claim 17, further comprising:

a spring pin selectively engaging the upper retaining bracket to secure the user-interface in the retained position, and wherein the user-interface moves to the open rest position when the upper retaining bracket is released from the engagement with the spring pin.

19. The user-interface assembly of claim 17, wherein the lower retaining bracket engages an edge defining the aperture when the user-interface rotates between the retained position and the open rest position.

20. The user-interface assembly of claim 16, wherein the panel defines a flange extending from an edge defining the aperture, and wherein the bracket arm defines a bracket slot that engages a flange slot of the flange to retain the user-interface in the access position.

* * * * *